US007390524B1

(12) United States Patent
Chen

(10) Patent No.: US 7,390,524 B1
(45) Date of Patent: Jun. 24, 2008

(54) METHOD FOR ELECTROSTATIC SPRAYING OF AN ABLUMINAL STENT SURFACE

(75) Inventor: Yung-Ming Chen, Cupertino, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 730 days.

(21) Appl. No.: 10/851,411

(22) Filed: May 20, 2004

(51) Int. Cl.
*B05D 3/14* (2006.01)

(52) U.S. Cl. ..... 427/2.24; 427/2.25; 427/458; 427/472; 427/473; 427/475; 427/485; 427/486

(58) Field of Classification Search ..... 427/2.24, 427/2.25, 458, 472, 473, 475, 485, 486
See application file for complete search history.

(56) References Cited

U.S. PATENT DOCUMENTS

| | | | | |
|---|---|---|---|---|
| 5,470,603 | A | 11/1995 | Staniforth et al. | 427/2.14 |
| 5,656,080 | A | 8/1997 | Staniforth et al. | 118/20 |
| 5,824,049 | A | 10/1998 | Ragheb et al. | 623/1 |
| 6,096,070 | A | 8/2000 | Ragheb et al. | 623/1 |
| 6,117,479 | A | 9/2000 | Hogan et al. | 427/2.14 |
| 6,406,738 | B1 | 6/2002 | Hogan et al. | 427/2.14 |
| 6,669,980 | B2 | 12/2003 | Hansen | 427/2.24 |
| 6,743,463 | B2 * | 6/2004 | Weber et al. | 427/2.24 |
| 6,982,004 | B1 * | 1/2006 | Malik et al. | 118/634 |
| 2003/0054090 | A1 | 3/2003 | Hansen | 427/2.1 |
| 2003/0113445 | A1 | 6/2003 | Martin | 427/180 |
| 2003/0138487 | A1 | 7/2003 | Hogan et al. | 424/474 |
| 2003/0185964 | A1 | 10/2003 | Weber et al. | 427/2.25 |

FOREIGN PATENT DOCUMENTS

| | | | |
|---|---|---|---|
| EP | 0526606 | B1 | 9/1992 |
| EP | 1075838 | A2 | 2/2001 |
| EP | 0869847 | B1 | 3/2003 |
| EP | 0941072 | B1 | 1/2004 |
| GB | 216086 | B1 | 1/2000 |
| GB | 2316342 | B | 1/2000 |
| GB | 2333975 | B | 1/2000 |
| GB | 2336551 | B | 1/2000 |
| GB | 2356586 | A | 5/2001 |
| GB | 2356587 | A | 5/2001 |
| GB | 2333474 | B | 6/2001 |
| GB | 2334685 | B | 6/2001 |
| GB | 2356585 | B | 7/2001 |
| GB | 2374302 | A | 8/2001 |
| GB | 2370243 | A | 6/2002 |
| GB | 2384199 | A | 7/2003 |
| JP | 2919971 | | 7/1999 |
| WO | WO 96/35516 | | 11/1996 |
| WO | WO 98/20863 | | 5/1998 |
| WO | WO 01/43727 | | 6/2001 |
| WO | WO 01/57144 | | 8/2001 |
| WO | WO 02/49771 | | 6/2002 |
| WO | WO 02/087550 | | 11/2002 |
| WO | WO 03/007918 | | 1/2003 |
| WO | WO 03/007919 | | 1/2003 |

(Continued)

*Primary Examiner*—Erma Cameron
(74) *Attorney, Agent, or Firm*—Squire Sanders & Dempsey, LLP

(57) ABSTRACT

A method for electrostatic spraying of an abluminal surface of a stent is provided.

9 Claims, 5 Drawing Sheets

FOREIGN PATENT DOCUMENTS

| | | |
|---|---|---|
| WO | WO 03/061841 | 7/2003 |
| WO | WO 03/072084 | 9/2003 |
| WO | WO 03/072086 | 9/2003 |
| WO | WO 2004/017947 | 3/2004 |
| WO | WO 2004/017976 | 3/2004 |
| WO | WO 2004/024339 | 3/2004 |

* cited by examiner

METHOD FOR ELECTROSTATIC SPRAYING OF AN ABLUMINAL STENT SURFACE

TECHNICAL FIELD

This invention relates to method for electrostatic coating of stents, more specifically to a Faraday Cage based method used during the electrostatic coating process.

BACKGROUND

Blood vessel occlusions are commonly treated by mechanically enhancing blood flow in the affected vessels, such as by employing a stent. Stents act as scaffoldings, functioning to physically hold open and, if desired, to expand the wall of affected vessels. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that often produce adverse or even toxic side effects for the patient.

One method of medicating a stent involves the use of a polymeric carrier coated onto the surface of the stent. A composition including a solvent, a polymer dissolved in the solvent, and a therapeutic substance dispersed in the blend can be applied to the stent by immersing the stent in the composition or by spraying the composition onto the stent. The solvent is allowed to evaporate, leaving on the surfaces a coating of the polymer and the therapeutic substance impregnated in the polymer.

The dipping or spraying of the composition onto the stent can result in a complete coverage of all stent surfaces, i.e., both luminal (inner) and abluminal (outer) surfaces, with a coating. However, from a therapeutic standpoint, drugs need only be released from the abluminal stent surface, and possibly the sidewalls. Moreover, having a coating on the luminal surface of the stent can have a detrimental impact on the stent's deliverability as well as the coating's mechanical integrity. A polymeric coating can increase the coefficient of friction between the stent and the delivery balloon. Additionally, some polymers have a "sticky" or "tacky" nature. If the polymeric material either increases the coefficient of friction or adherers to the catheter balloon, the effective release of the stent from the balloon upon deflation can be compromised. Severe coating damage at the luminal side of the stent may occur post-deployment, which can result in a thrombogenic surface. Accordingly, there is a need to eliminate or minimize the amount of coating that is applied to the inner surface of the stent. Reducing or eliminating the polymer from the stent luminal surface also means a reduction in total polymer load, which will minimize the material-vessel interaction and is therefore a desirable goal for optimizing long-term biocompatibility of the device.

A method for preventing the composition from being applied to the inner surface of the stent is by placing the stent over a mandrel that fittingly mates within the inner diameter of the stent. A tubing can be inserted within the stent such that the outer surface of the tubing is in contact with the inner surface of the stent. With the use of such mandrels, some incidental composition can seep into the gaps or spaces between the surfaces of the mandrel and the stent, especially if the coating composition includes high surface tension (or low wettability) solvents. Moreover, a tubular mandrel that makes contact with the inner surface of the stent can cause coating defects. A high degree of surface contact between the stent and the supporting apparatus can provide regions in which the liquid composition can flow, wick, and/or collect as the composition is applied to the stent. As the solvent evaporates, the excess composition hardens to form excess coating at and around the contact points between the stent and the support apparatus, which may prevent removal of the stent from the supporting apparatus. Further, upon removal of the coated stent from the support apparatus, the excess coating may stick to the apparatus, thereby removing some of the coating from the stent and leaving bare areas. In some situations, the excess coating may stick to the stent, thereby leaving excess coating composition as clumps or pools on the struts or webbing between the struts. Accordingly, there is a tradeoff when the inner surface of the stent is masked in that coating defects such as webbing, pools and/or clumps can be formed on the stent.

In addition to the above mentioned drawbacks, other disadvantages associated with dip and spray coating methods include lack of uniformity of the produced coating as well as product waste. The intricate geometry of the stent presents a great degree of challenges for applying a coating material on a stent. Dip coating application tends to provide uneven coatings and droplet agglomeration caused by spray atomization process can produce uneven thickness profiles. Moreover, a very low percentage of the coating solution that is sprayed to coat the stent is actually deposited on the surfaces of the device. A majority of the sprayed solution is wasted in both application methods.

To achieve better coating uniformity and less waste, electrostatic coating deposition has been proposed. Examples in patent literature covering electrostatic deposition include U.S. Pat. Nos. 5,824,049 and 6,096,070. Briefly, referring to FIG. 1, for electro-deposition or electrostatic spraying, a stent 100 is grounded and gas is used to atomize the coating solution into droplets 110 as the coating solution is discharged out from a nozzle 120. The droplets 110 are then electrically charged by passing through an electrical field created by a ring electrode 130 which is in electrical communication with a voltage source 140. The charged particles are attracted to the grounded metallic stent. An alternative design for coating a stent with an electrically charged solution is disclosed by U.S. Pat. No. 6,669,980. U.S. Pat. No. 6,669,980 teaches a chamber that that contains a coating formulation that is connected to a nozzle apparatus. The coating formulation in the chamber is electrically charged. Droplets of electrically charged coating formulation are created and dispensed through the nozzle and are deposited on the grounded stent. Stents coated with electrostatic techniques have many advantages over dipping and spraying methodology, including, but not limited to, improved transfer efficiency (reduction of drug and/or polymer waste), high drug recovery on the stent due to elimination of re-bounce of the coating solution off of the stent, better coating uniformity, and a faster coating process. Formation of a coating layer on the inner surface of the stent is not, however, eliminated with the used of electrostatic deposition. With the use of mandrels that ground the stent and provide for a tight fit between the stent and the mandrel, formation of coating defects such as webbing, pooling and clumping remain a problem. If a space is provided between the mandrel and the stent, such that there is only minimal contact to ground the stent, the spraying can still penetrated into the gaps between the stent struts and coat the inner surface of the stent. Conventional stent geometry does not provide for a good Faraday cage due to the interspace between the struts of the stent. As illustrated by FIG. 2, electric field lines can penetrated into the opening between the struts and deposit a coating on the inner surface of the stent. This is known as the "wrap around" effect. Charged particles are not only disposed on the outer surface of the stent, but also are wrapped around each strut and are attracted to the inner surface of the stent.

Accordingly, what is needed is a stent and method that allows for electro-deposition or electrostatic spraying of a stent while eliminating or minimizing the wrap around effect.

SUMMARY

Embodiments of the invention provide a method for the electrostatic spraying of a substance onto an abluminal stent surface and that eliminates or reduces the wrap around effect. In an embodiment of the invention, a method comprises mounting a stent on a support in a configuration such that the stent forms a Faraday Cage between at least two of the stent struts; charging a substance; and applying the charged substance onto the stent.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The following description is provided to enable any person having ordinary skill in the art to make and use the invention, and is provided in the context of a particular application and its requirements. Various modifications to the embodiments will be readily apparent to those skilled in the art, and the generic principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

It is believed that the embodiments of the invention can provide for a uniform coating, prevent excess waste associated with conventional dip and spray coating processes, and prevent a coating from being formed on the inner surface of the stent or reduce the amount of coating that is formed on the inner surface of the stent. This reduces the total polymer load on a stent, thereby improving long-term biocompatibility and ensuring that most of the coating is on the abluminal surface where it provides the most benefit. Further, problematic interactions between a delivery mechanism (e.g., delivery balloon) and the stent luminal surface are eradicated, thereby increasing the ease of stent deliverability.

Figure 1:
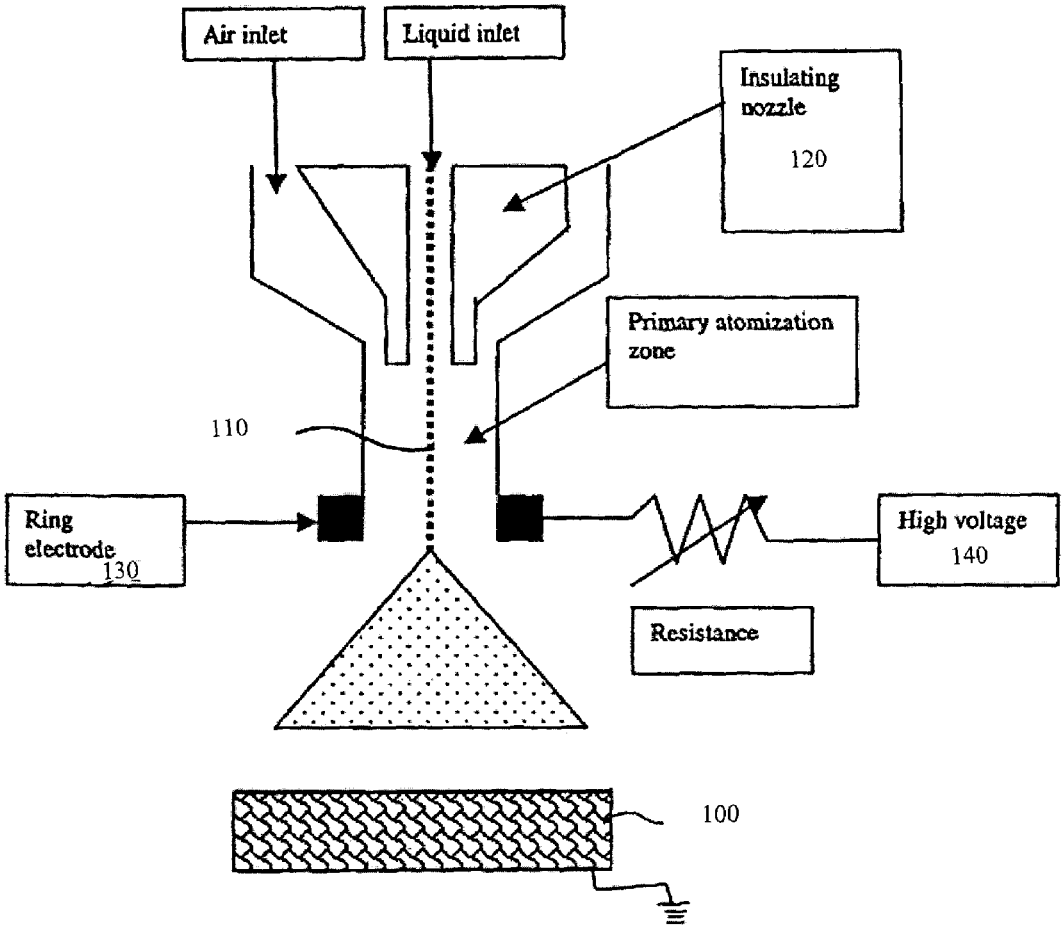
FIG. 1 is a diagram illustrating an electrostatic spray coating system.
Figure 2:
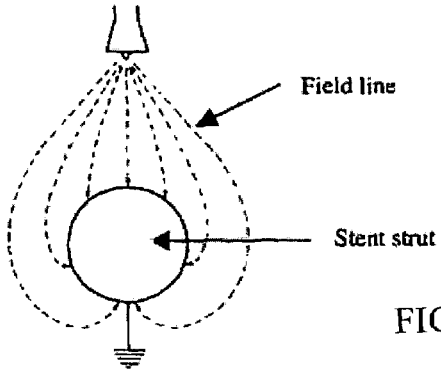
FIG. 2 illustrates the wrap around effect on a stent strut.
Figure 3:
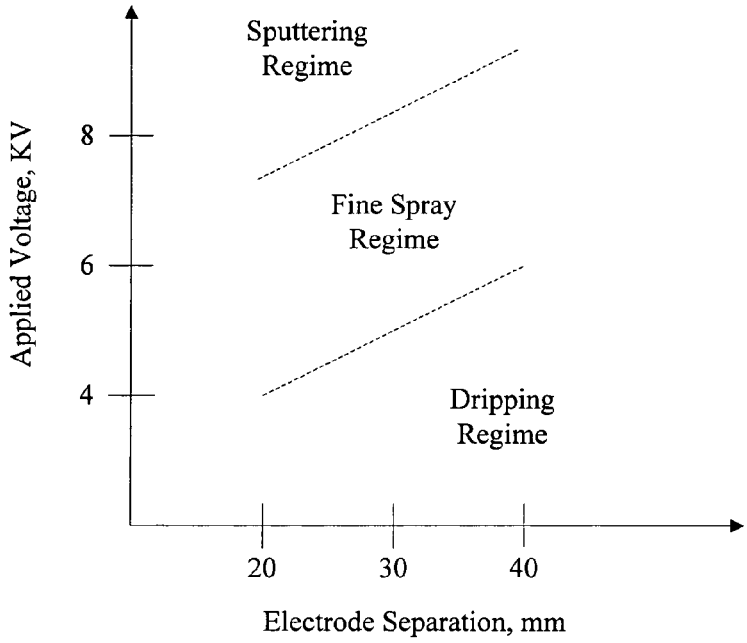
FIG. 3 is a chart illustrating spray regimes as a function of applied voltage and electrode separation.

FIG. 3 is chart illustrating spray regimes as a function of applied voltage and electrode separation. Applied voltage is from the high voltage 140. Electrode separation refers to the distance between the stent 100 and the ring electrode 130. Ideally, appropriate voltage is applied to enter the fine spray regime, which provides adequate atomization. If inadequate voltage is applied, there will not be sufficient atomization, thereby causing the composition to exit the electrostatic spray device as a drip instead of as the atomized spray. Too much voltage on the other hand will lead to a sputtering regime in which the composition exits the electrostatic spray device in spurts instead of as an atomized spray.

Figure 4:
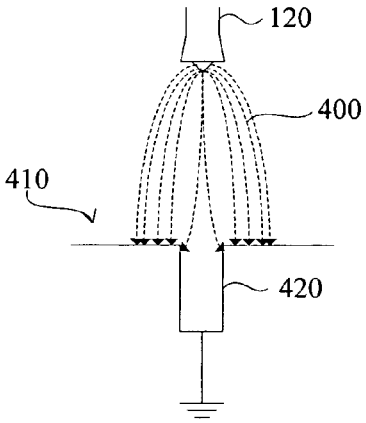
FIG. 4 is a diagram illustrating the Faraday Cage effect.

FIG. 4 is a block diagram illustrating the Faraday Cage effect. A Faraday Cage shields electric fields from the interior of a conductor. As such, a Faraday Cage is sometimes also referred to as a Faraday Shield. In a Faraday Cage, charge on a charged conductor resides only at the exterior surface of the conductor and does not enter the interior of the conductor. A Faraday Cage can have a solid conducting surface or can have a fine mesh surface.

During an electrostatic spray process of an object 410, electric field lines 400 are formed between electrodes, i.e., the nozzle 120 and the object 410. The object 410, which is grounded, forms a Faraday Cage that prevents the electric field lines 400 from entering the interior of the object 410 and further prevents intrusion of the field lines 400 into apertures, such as aperture 420 of the object 410. As will be discussed further below, if the object 410 includes a stent, such as the stent 100, having a minimal interspacing between struts, the stent 100 when grounded will become a Faraday Cage and repel electric field lines 400 from the interior luminal stent 100 surface. Accordingly, during an electrostatic spray process, the sprayed composition or coating substance, which follows the electric field lines 400, will only coat the abluminal surface of the stent 100.

The components of the coating substance or composition can include a solvent or a solvent system comprising multiple solvents; a polymer or a combination of polymers; and/or a therapeutic substance or a drug or a combination of drugs. Representative examples of polymers that can be used to coat a stent or medical device include ethylene vinyl alcohol copolymer (commonly known by the generic name EVOH or by the trade name EVAL); poly(hydroxyvalerate); poly(L-lactic acid); polycaprolactone; poly(lactide-co-glycolide); poly(glycerol-sebacate); poly(hydroxybutyrate); poly(hydroxybutyrate-co-valerate); polydioxanone; polyorthoester; polyanhydride; poly(glycolic acid); poly(D,L-lactic acid); poly(glycolic acid-co-trimethylene carbonate); polyphosphoester; polyphosphoester urethane; poly(amino acids); cyanoacrylates; poly(trimethylene carbonate); poly(iminocarbonate); co-poly(ether esters); polyalkylene oxalates; polyphosphazenes; biomolecules, such as fibrin, fibrinogen, starch, collagen and hyaluronic acid; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrilestyrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose; cellulose acetate; cellulose butyrate; cellulose acetate butyrate; cellophane; cellulose nitrate; cellulose propionate; cellulose ethers; and carboxymethyl cellulose.

"Solvent" is defined as a liquid substance or composition that is compatible with the polymer and/or drug and is capable of dissolving the polymer and/or drug at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methylpyrrolidinone, toluene, and mixtures and combinations thereof. Solvents should have a high enough conductivity to enable ionization of the composition if the polymer or therapeutic substance is not conductive. For example, acetone and ethanol have sufficient conductivities of $8\times10^{-6}$ and $\sim10^{-5}$ siemen/m, respectively.

Examples of therapeutic substances that can be used include antiproliferative substances such as actinomycin D, or derivatives and analogs thereof (manufactured by Sigma-Aldrich of Milwaukee, Wis., or COSMEGEN available from Merck). Synonyms of actinomycin D include dactinomycin, actinomycin IV, actinomycin $I_1$, actinomycin $X_1$, and actinomycin $C_1$. The active agent can also fall under the genus of antineoplastic, anti-inflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. Taxotere®, from Aventis S.A., Frankfurt, Germany) methotrexate, azathioprine, vincristine, vinblastine, fluorouracil, doxorubicin hydrochloride (e.g. Adriamycin® from Pharmacia & Upjohn, Peapack N.J.), and mitomycin (e.g. Mutamycin® from Bristol-Myers Squibb Co., Stamford, Conn.). Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as ANGIOMAX (Biogen, Inc., Cambridge, Mass.). Examples of such cytostatic or antiproliferative agents include angiopeptin, angiotensin converting enzyme inhibitors such as captopril (e.g. Capoten® and Capozide® from Bristol-Myers Squibb Co., Stamford, Conn.), cilazapril or lisinopril (e.g. Prinivil® and Prinzide® from Merck & Co., Inc., Whitehouse Station, N.J.); calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name Mevacor® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate include alpha-interferon, genetically engineered epithelial cells, tacrolimus, dexamethasone, and rapamycin and structural derivatives or functional analogs thereof, such as 40-O-(2-hydroxy)ethyl-rapamycin (known by the trade name of everolimus and available from Novartis), 40-O-(3-hydroxy)propyl-rapamycin, 40-O-[2-(2-hydroxy)ethoxy]ethyl-rapamycin, and 40-O-tetrazole-rapamycin.

Figure 5:
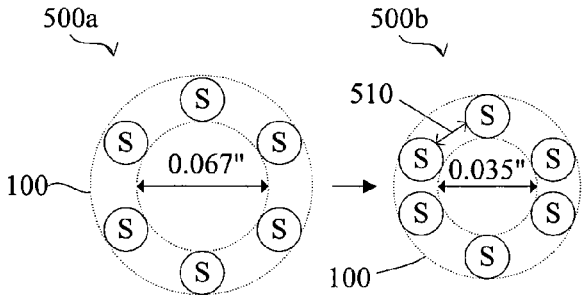
FIG. 5 is a diagram illustrating the modification of a stent to generate the Faraday Cage effect.

FIG. 5 is a diagram illustrating the modification of the stent diameter to generate the Faraday Cage effect. Modification depends on the type, design and size of the stent, including the diameter of the stent and the distance between the stent struts. Accordingly, in some embodiments, modification can be done by reducing the diameter of the stent so as to bring the struts closer together. In some embodiments, modification can include radially expanding the stent to reduce coating defects (which are increased when the struts are too close together), and the stent is expanded to a dimension that the Faraday Cage effect is maintained. Optimization of preventing the wrap around effect and coating defects depends, in part, on the type and design of stent used. In the embodiment illustrated by FIG. 5, a reduction of diameter from 500*a* to 500*b* is illustrated so as to create a Faraday Cage.

Stents can have a collapsed and reduced configuration as well as an intended deployment or expanded configuration. The collapsed configuration is the state in which the diameter of a stent cannot be reduced to a greater extent without causing damage to the stent which would render the stent unusable. The intended deployment configuration is provided by the manufacturer of a stent or can be determined by one having ordinary skill in the art and is intended to include the range of diameter of use or the range of pressure to be applied for the planned performance of the stent. Reduced configuration is any configuration between collapsed configuration and intended deployment state so long as the effect of preventing or reducing the wrap around effect is achieved through formation of a Faraday Cage. In one embodiment, collapsed or reduced configuration means without causing stent struts to overlap so as not only to provide for a Faraday cage, but also to prevent coating defects such as webbing. Over or hyper-expansion is dilation of a stent beyond intended deployment configuration. In some embodiments, over or hyperinflation is defined as any diameter above the intended expanded configuration but less than a diameter or size in which the stent will be damaged or no longer suitable for its intended use. The diameter of a stent and in essence the gap between the struts must be optimized so as to prevent or reduce the wrap around effect as well as coating defects. In some embodiments, a stent is coated in the collapsed configuration. In yet another embodiment, the stent is coated in a reduced configuration. In yet another embodiment, the stent is coated in its expanded configuration. It is also conceivable that some stents can be coated in a hyper-expanded state; however, as the spaces between the struts increases so does the wrap around effect.

By way of example, to illustrate one embodiment of the invention, referring to FIG. 5, through techniques known to one of ordinary skill in the art, the stent 100 is crimped to the collapsed or reduced state 500*b* from its original state (as cut from a hypo tube) 500*a* so that the maximum space between adjacent struts S of the stent 100, as indicated by the arrow 510, is no more than, on average, about 0.005 inches to about 0.010 inches. Not all spacing between adjacent struts S need to be in the cited range as long as the average spacing is within the cited range. A Faraday Cage should be formed by this modification. Further, the inner diameter of the stent 100 can be reduced to as far as about 0.0025 inches. Further reduction of the inner diameter of the stent 100 may cause overlapping of the stent struts S, which can cause coating defects. If overlapping can be avoided, the inner diameter of the stent 100 can be reduced still further without the risk of webbing between adjacent struts S and other coating defects because the Faraday Cage effect prevents coating of the sidewalls of the struts S.

In another embodiment of the invention, the stent 100 can be formed with any required inner diameter (e.g., in an intended deployment or expanded configuration) but with adjacent stent struts S spaced apart with a maximum average distance of between about 0.005 inches to about 0.010 inches. Spacing can be even smaller if stent strut overlap is avoided, which enhances the Faraday Cage effect. Accordingly, crimping of the stent 100 would not be needed during the electrostatic spray process.

Electrospray allows for the deposition of a coating on a stent in a collapsed or reduced state without creating the defects that are produced by conventional spray or dipping process if the stent is collapsed or reduced in diameter. Electro-deposition includes smaller droplets than conventional air-assisted spray technique. Coating a stent using the conventional air-assisted spray method generally requires a stent with larger interspace between struts (typical a larger inner diameter stent) to avoid the coating defects, and therefore, requires a precrimp step followed by a crimp step to mount the stent on a catheter. Coating a precrimped stent using electrospray, especially for brittle polymer systems like polylactic acid (PLA), will avoid possible coating damage caused by the precrimping process. Accordingly, electrospray offers the benefit of reducing coating damage which can be induced at stent precrimping/crimping steps.

In an embodiment of the invention, a stent can include, but is not limited to, neurological, coronary, peripheral and urological stents. Stent materials includes, but are not limited to, cobalt chromium alloy (ELGILOY), stainless steel (316L or 300 series), high nitrogen stainless steel, e.g., BIODUR 108, cobalt chrome alloy L-605, "MP35N," "MP20N," ELASTINITE (Nitinol), tantalum and alloys thereof, nickel-titanium alloy, platinum-iridium alloy, gold, magnesium, or combinations thereof. "MP35N" and "MP20N" are trade names for alloys of cobalt, nickel, chromium and molybdenum available from Standard Press Steel Co., Jenkintown, Pa. "MP35N" consists of 35% cobalt, 35% nickel, 20% chromium, and 10% molybdenum. "MP20N" consists of 50% cobalt, 20% nickel, 20% chromium, and 10% molybdenum.

Figure 6A:
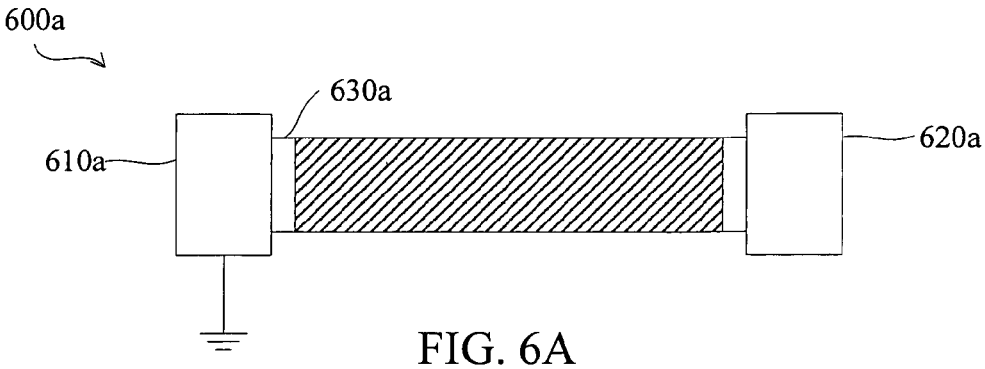
FIGS. 6A and 6B are diagrams illustrating two stent mandrels for use in an electrostatic spray system.
Figure 6B:
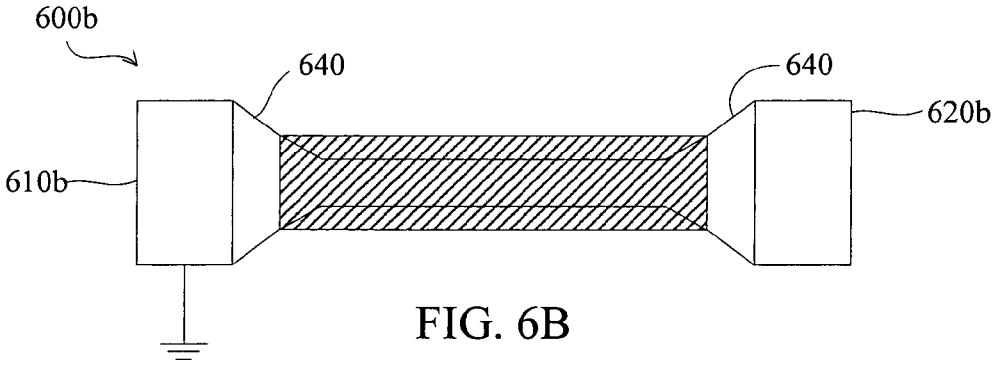

FIGS. 6A and 6B are diagrams illustrating two stent mandrels 600*a* and 600*b*, respectively, for use in an electrostatic spray system. Referring to FIG. 6A, a mandrel fixture 600*a* can include a support member 610*a* that engages or is disposed in one end of the stent 100 and a lock member 620*a* that engages or is disposed in the opposing end of the stent 100. The support member 610*a* and the lock member 620*a* can be coupled together by a mandrel arm 630*a* that extends through the longitudinal bore of the stent 100. The arm 630*a* can be permanently coupled to the support member 610*a* and releasable coupled to the lock member 620*a*, such as by a screw fit or a friction fit. The support member 610*a* and/or lock member 620*a* can be in conductive communication with the stent 100. In an embodiment of the invention, the arm 630*a* can have a diameter approximately equal to the inner diameter of the stent 100 so as to support the stent 100 during an electrostatic spray process.

In another embodiment of the invention, a mandrel fixture 600*b*, as shown in FIG. 6B, includes a support member 610*b* and/or a lock member 620*b* that can have a coning end portions 640 that penetrate partially into the stent 100 ends and allow the stent 100 to rest thereon. In some embodiments, the tip 640 should be large enough so as to allow for nominal conductive contact between the fixture 600*b* and the stent 100. It will be appreciated by one of ordinary skill in the art that other stent mandrels may be used during electrostatic spraying.

Figure 7:
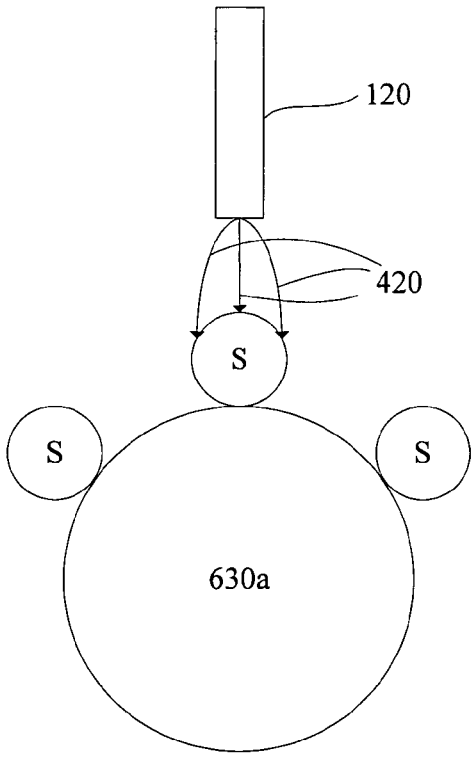
FIG. 7 is a diagram illustrating a magnified cross section of a portion of the electrostatic spray coating system during operation.

FIG. 7 is a diagram illustrating a magnified cross section of a portion of an electrostatic spray coating system during operation. Electric field lines 420 extend downward from the nozzle 120 towards the struts S of the stent 100. Due to the Faraday Cage formed by the stent 100, the field lines 420 do not wrap around the stent 100 struts S or otherwise enter the interior of the stent 100. Accordingly, during an electrostatic spray coating process the droplets 110 follows the electric field lines 420 coating only the abluminal surface of the stent 100. In some embodiments, the coating of side wall of struts S can also prevented and or reduced. Nominal coating of the sidewall, however, might occur, depending on the process parameters employed.

In some embodiments, during the spray coating process, the stent 100 is in electrical contact with the stent mandrel fixture 600*a* or 600*b* and is grounded and/or can be supplied with a charge opposite the charge of the spray 110. The fixture 600*a* or 600*b* can be supplied with an opposite charge by electrically coupling the fixture 600*a* or 600*b* to a power source, which supplies a first charge to the droplets 110 and an opposite charge to the fixture 600*a* or 600*b*. This difference in polarity increases the attraction of the droplets 110 to the stent 100, therefore increasing coating of the stent 100. This difference in polarity can also compensate for misalignment of the nozzle 120 with the stent 100, which is a critical issue in the conventional applications of a composition of a drug to a stent. Specifically, the polarity difference will pull the spray 110 towards the stent 100 even if the stent 100 is not positioned directly beneath the nozzle 120.

Figure 8:
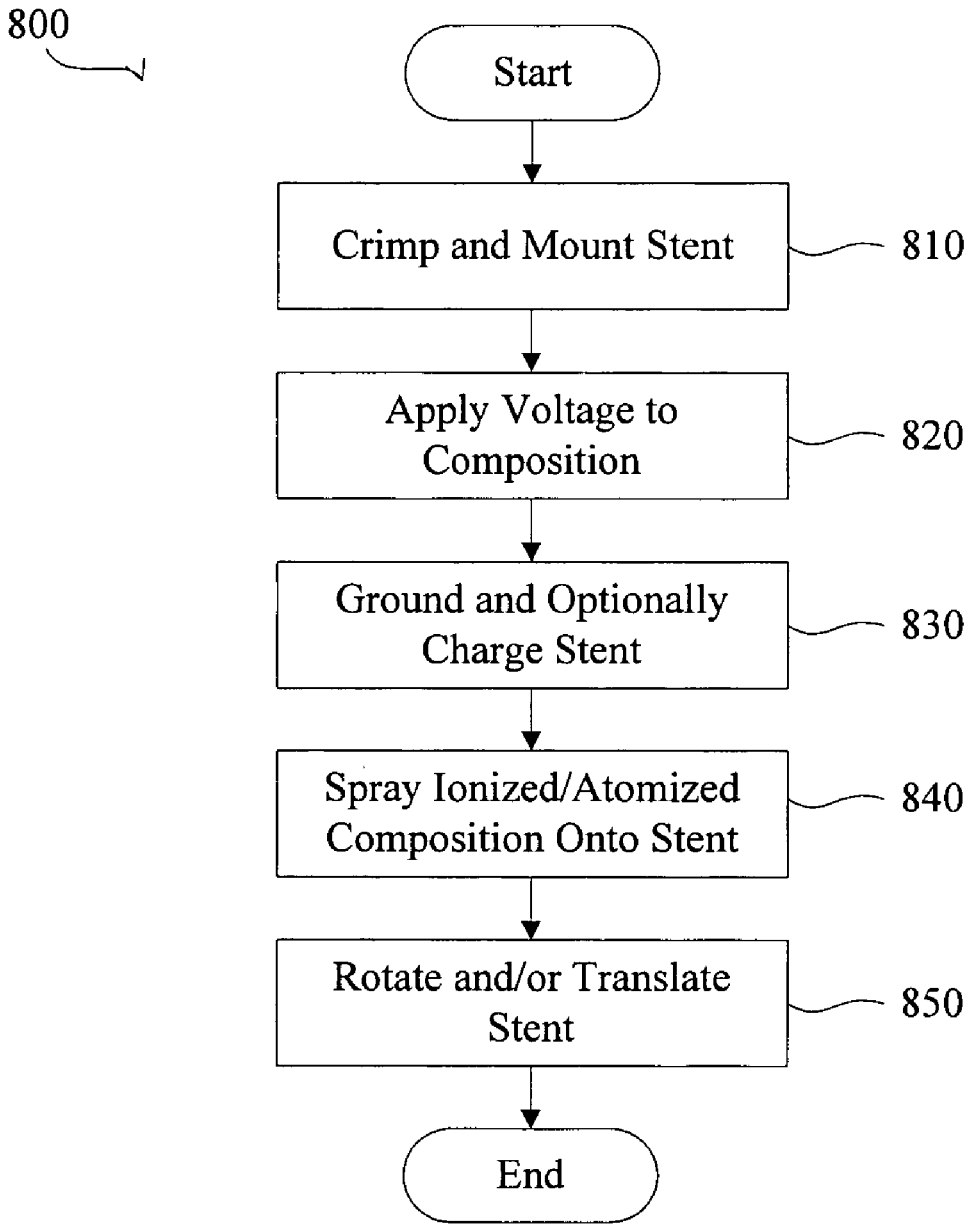
FIG. 8 is a flowchart illustrating a method of electrostatic spray coating.

FIG. 8 is a flowchart illustrating a method 800 of electrostatic spray coating. First, a stent 100 is crimped or mounted (810) to form a Faraday Cage on a mandrel, such as the mandrel 600*a* or 600*b*. Crimped is defined as mounting of a stent on a support so as to provide for a Faraday Cage. In some embodiments, during the act of crimping, the diameter of the stent is reduced. As discussed above, in order to form a Faraday Cage, the spacing between adjacent struts of the stent 100 can be reduced on average to at least about 0.01 inches. A voltage is then applied (820) to the composition by, for example, applying voltage to the ring electrode 130. In an embodiment, the voltage can range from about 3-20 kV and more particularly from about 4-10 kV. The stent 100 is then grounded (830) or optionally charged to attract the spray 110. The atomized/ionized composition from the nozzle 120 is then sprayed (840) onto the stent 100. The atomization could be with or without the assistance of a gas. The stent 100 is then rotated and/or translated (850) during the spraying (840). The method 800 then ends.

The following example is provided:

EXAMPLE I

Figure 9:
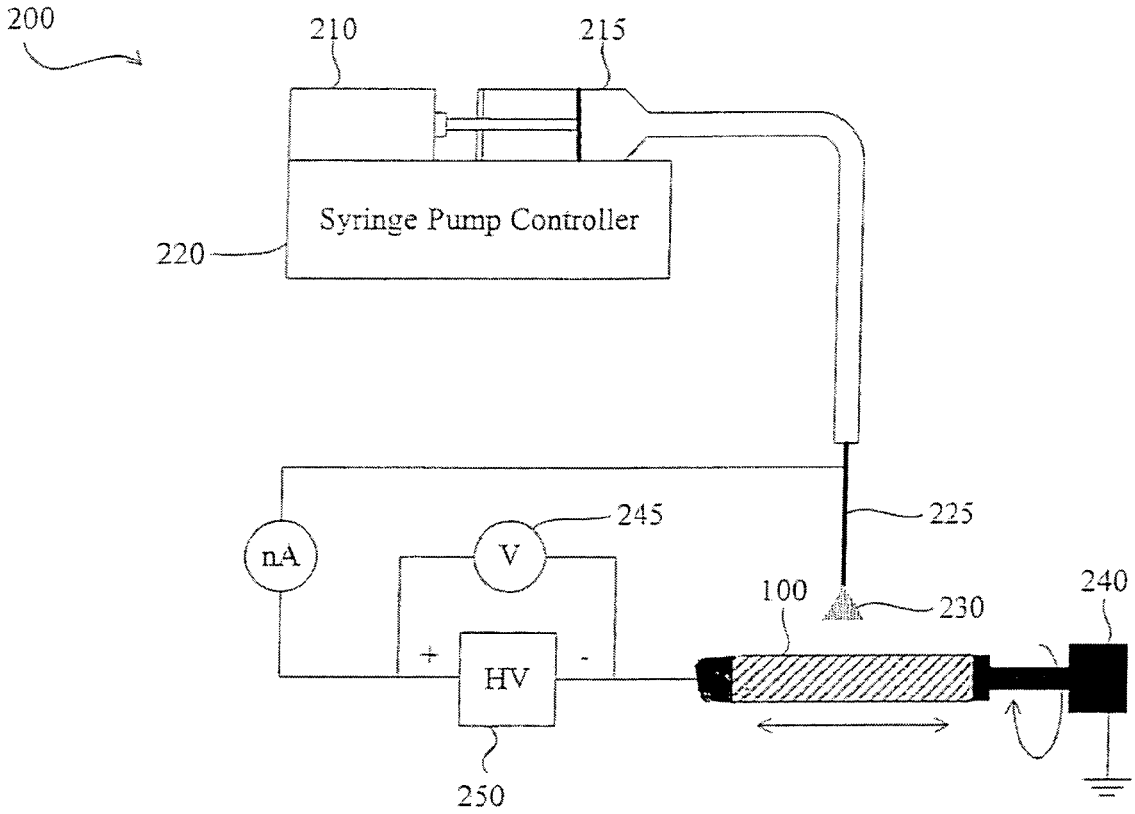
FIG. 9 is electrostatic spray coating system for Example I.

In an example electrostatic spray process, a 18 mm VISION small stent (available from Guidant Corp.) with an inner diameter of 0.067 inches, as cut, was crimped to 0.035 inches without struts touching each other. A total of 500 μg of PLA/everolimus coating (1:1 polymer to drug ratio) was deposited over the stent using electrostatic spraying and the applied voltage is in the range of 5 to 7 KV. The stent was translated back and forth under the spray nozzle at a speed 6 mm/sec; also the stent was rotated at 40 rpm. Minimal coating was found on the inner diameter of the VISION stent. FIG. 9 illustrates an electrostatic spray coating system 200 similar to the one used for Example I. The system 200 includes a syringe pump controller 220 communicatively coupled to a pump 210 (e.g., a Harvard syringe pump model 11) that pumps a syringe 215 holding the composition. The syringe 215 dispenses the composition onto the stent 100 via a metallic dispensing tip, hypotube 225. The stent 100 is mounted on a stent mandrel fixture 240 that can provide translational and rotational movement of the stent 100 during a coating process. The stent 100 can be located, for example, approximately 20-25 mm downstream from the hypotube 225. In Example I, it was held at about 20 mm. A power source 245 is coupled to a high voltage transformer 250 that converts voltage from the power source 245 to a high voltage (e.g., up to 20 kV), which is then applied to the hypotube 225. The high voltage ionizes the composition into atomized ionized (e.g., negatively or positively charged) droplets in a spray 230 without the need for atomizing air.

While particular embodiments of the present invention have been shown and described, it will be obvious to one of ordinary skill in the art that changes and modifications can be made without departing from this invention in its broader aspects. For example, after application of the coating to the abluminal surface of the stent 100 as described above, the luminal surface of the stent 100 can be coated with a different coating via spray coating, electroplating or other technique. Therefore, the appended claims are to encompass within their scope all such changes and modifications as fall within the true spirit and scope of this invention.

What is claimed is:

1. A method of coating a stent with a substance, comprising:

mounting a stent on a support in a configuration such that the stent forms a Faraday Cage between at least two of the stent struts;

charging the substance; and applying the charged substance onto the stent.

2. The method of claim 1, wherein the diameter of the stent is adjusted to form the Faraday Cage.

3. The method of claim 1, wherein spacing between the struts is adjusted to form a Faraday Cage.

4. The method of claim 1, wherein spacing between the struts is minimized to form a Faraday Cage.

5. The method of claim 4, wherein the maximum spacing between the struts is no more than about 0.01 inches.

6. The method of claim 4, wherein the struts do not overlap.

7. The method of claim 1, wherein the stent is configured with a collapsed configuration and an expanded configuration, wherein the stent forms a Faraday Cage in the collapsed configuration prior to applying the charged substance onto the stent.

8. The method of claim 1, wherein the stent is configured with a reduced configuration such that the stent forms a Faraday Cage in the reduced configuration prior to applying the charged substance onto the stent.

9. The method of claim 1, wherein the stent is in electrical communication with the support.

* * * * *